United States Patent [19]

Zaharia

[11] 4,141,294

[45] Feb. 27, 1979

[54] FUEL-AIR TYPE BOMB

[75] Inventor: Sidney D. Zaharia, Westminster, Colo.

[73] Assignee: Beech Aircraft Corporation, Wichita, Kans.

[21] Appl. No.: 823,235

[22] Filed: Apr. 28, 1969

[51] Int. Cl.[2] ..... F42B 25/12

[52] U.S. Cl. ..... 102/6; 102/34.4

[58] Field of Search ..... 102/6, 34.4

[56] References Cited

U.S. PATENT DOCUMENTS

| | | | |
|---|---|---|---|
| 2,445,311 | 7/1948 | Cooke et al. | 102/6 |
| 2,445,312 | 7/1948 | Cooke et al. | 102/6 |
| 2,535,309 | 12/1950 | Mari | 102/34.4 |
| 2,742,856 | 4/1956 | Fieser et al. | 102/6 |

*Primary Examiner*—David H. Brown

*Attorney, Agent, or Firm*—Edward L. Brown, Jr.

[57] ABSTRACT

A highly destructive fuel-air type drop bomb which requires no retardation or restriction of its terminal velocity for efficient detonation; which utilizes a normally non-explosive, normally liquid fuel dispersed in air for its explosive power; which centrally carriers a low brisance heaving type fuel dispersing explosive surrounded by the body of liquid fuel; which includes a proximity fuse to detonate the low brisance explosive to break the fuel container and to disperse the fuel into the surrounding air in minute particles to form an aerosol cloud of large volume and of substantially uniform density in close proximity to the target; and which carries a time delay detonator for detonating the aerosol cloud after it has formed.

5 Claims, 3 Drawing Figures

INVENTOR.
SIDNEY D. ZAHARIA
BY Hubert D. Miller
ATTORNEY

FUEL-AIR TYPE BOMB

This invention relates to aerially delivered destructive bombs in general, and more particularly to a bomb which will herein be referred to as a fuel-air mixture type bomb, as opposed to a bomb the explosive power of which is provided by a concentrated highly explosive material. The high explosive bomb has a destructive effect over only a very limited target surface area, whereas the fuel-air bomb has a destructive effect over a much greater surface area.

Certain Government Agencies and their contractors have recently produced and tested fuel-air mixture type bombs, all of which have had critical disadvantages. The bombs tested have carried either pressurized propane or ethylene oxide as fuel to provide the ultimate explosive effect, when mixed with air. The fuel has been dispersed into the air by means of a high brisance explosive. Fuel dispersal by means of a high explosive has resulted in the formation of a doughnut shaped cloud of fuel-air mixture which cannot be efficiently detonated by detonators located in its void central area.

For this reason such bombs necessarily have had to carry numerous cloud detonators, together with a means for distributing these detonators into various locations within the surrounding doughnut shaped cloud prior to actuating the detonators. Since the downward velocity of travel of the bomb hardware, after fuel dispersal, is much greater than that of the doughnut shaped cloud, it has not been possible to properly distribute the detonators into the doughnut shaped fuel-air mixture without retarding the terminal velocity of the bomb.

Low terminal velocity for such bombs has been acheived by release of one or more bomb carried parachutes for the bomb at a predetermined time interval after bomb release from the carrier.

Retardation of bomb terminal velocity by parachutes constitutes another disadvantage of bombs of the fuel-air type previously tested.

Such parachute lowered bombs are subject to wind drift, enemy detection and dispersal prior to bomb detonation, hanging up in trees, etc. Furthermore, the detonation of a torus shaped cloud formed by liquid fuel dispersion in air does not produce either the desired intensity of explosive overpressure adjacent the target, or distribution of the overpressure over a sufficiently large area.

Generally, a bomb embodying my invention includes a housing having walls which define three separate sealed, concentrically arranged chambers. The smaller central burster chamber contains a low brisance heaving type explosive; the second and larger chamber which surrounds the central chamber, carries liquid fuel; and the third chamber, which surrounds the fuel chamber, contains an inert material having high vapor pressure and high heat capacity, such as Freon fluid.

At its forward end the bomb housing carries a sequence initiating proximity fuse of any desired type, connected by prima cord or electrical detonator extending well into the low brisance explosive in the central chamber.

Immediately adjacent the aft ends of the three chambers, the housing carries a fuel cloud detonating assembly which includes a time delay mechanism connected by prima cord or electrical detonator extending well into the low brisance explosive in the central burster chamber.

When the bomb closely approaches the target the proximity fuse is activated, the low brisance explosive is detonated, creating an internal pressure which ruptures the walls of all 3 chambers in the housing. The fuel is dispersed in minute particles into the surrounding air by the expanding pressure created by the explosion of the central burster charge. The fuel creates an expanding aerosol cloud of substantially uniform fuel-air density, and which is encompassed by a blanket of the Freon gas, which expands with the fuel-air cloud. The Freon serves to cool and maintain the aerosol cloud below its auto-ignition temperature.

Shock waves from the explosion of the low brisance central burster charge activate the time delay cloud detonator mechanism and the entire fuel-air cloud is detonated at a predetermined time after proximity fuse activation, for instance, 100 to 125 milliseconds, which affords ample time for the formation of an aerosol fuel air cloud of large volume extending over a large surface area.

Due to the fact that the low brisance explosive, such as 30% to 50% gelatin dynamite, creates a heaving outward pressure rather than an extreme shock, the aerosol type fuel-air cloud which is formed by my bomb is of substantially uniform density throughout its volume, as opposed to the doughnut shaped clouds formed by a high explosive. Due to its uniform density, the highly explosive fuel-air cloud formed by my bomb can be detonated at any location within the cloud boundary. Consequently in my bomb there is no necessity for discharging a plurality of cloud detonators into the cloud from the falling, ruptured bomb housing, and the necessity for retarding the terminal velocity of the bomb by parachute or other means is also eliminated. The cloud detonator assembly in my bomb is fixed to the bomb housing and remains with the ruptured housing as it falls through the aerosol cloud. The above are important advantages of my invention.

An additional advantage is the use of a fuel which is non-gaseous at standard temperature and pressure, thus eliminating the necessity of providing a pressurized fuel chamber. The use of a non-gaseous fuel, such as normal-propyl nitrate, is made possible by the provision of the Freon gas envelope which surrounds the aerosol cloud as it is formed, and prevents its autoignition.

My invention will be more clearly understood when the following description is read in connection with the accompanying drawings, in which.

Figure 1:
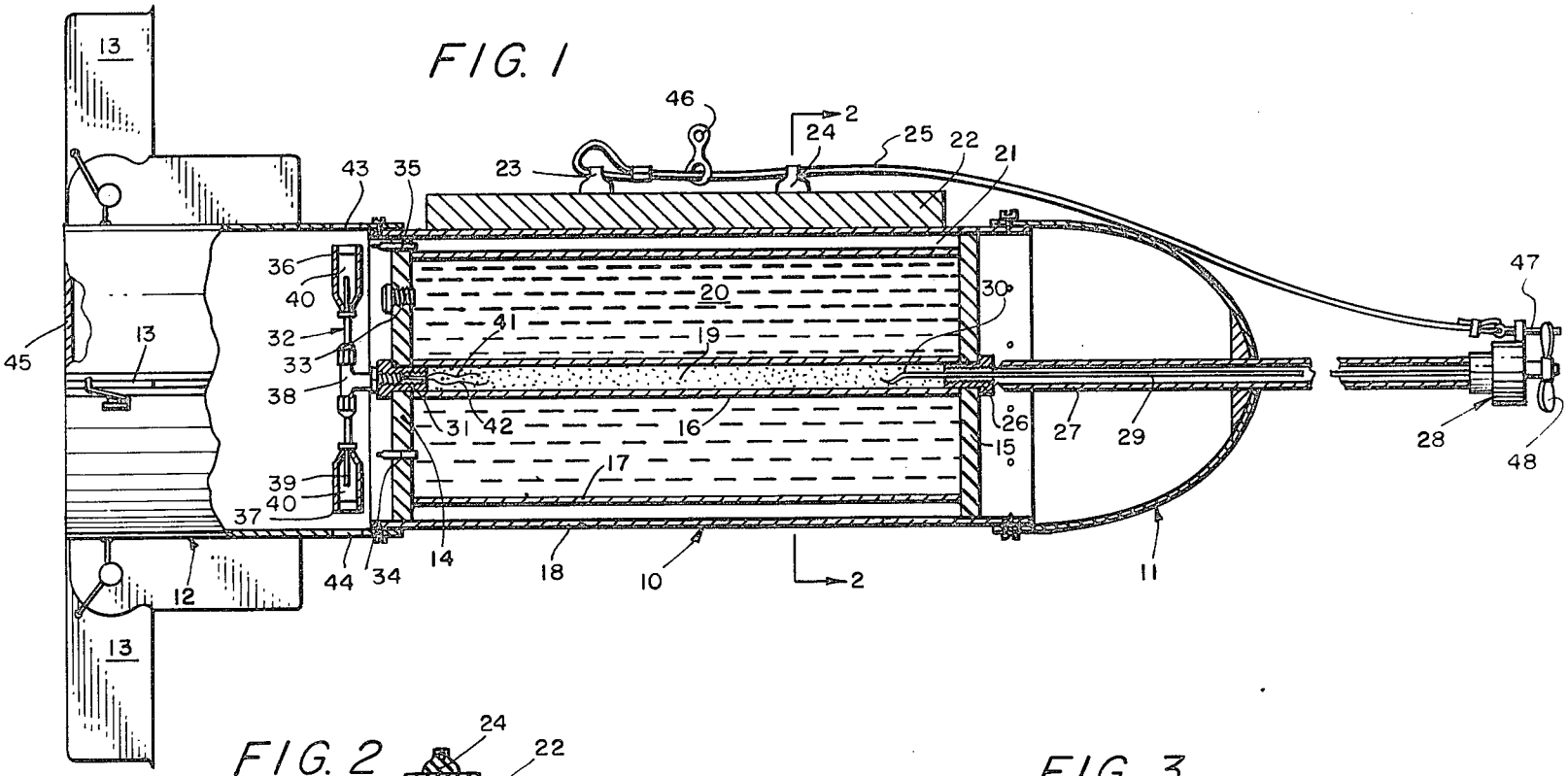
FIG. 1 is a central longitudinal sectional view through a bomb embodying my invention.

Referring to FIG. 1 of the drawings, the illustrated preferred embodiment of my invention includes a load carrying housing designated as a whole by the numeral 10; a combination nose cone and fuse supporting member, designated as a whole by the numeral 11, suitably secured to the forward end of housing 10; and a tail assembly rigidly secured to the aft end of housing 10 and designated as a whole by the numeral 12, and pivotally supporting a plurality of outwardly spring pressed, retractable stabilizing fins 13.

Housing 10 includes rigid circular end plates 14 and 15. Concentric cylindrical walls 16, 17 and 18 have their opposite ends secured to the respective end-plates in sealed, leak tight relationship, as by welding. The three walls thus define three separate, concentric sealed chambers 19, 20 and 21.

An elongated rigid stiffener and swaybrace 22 is secured longitudinally to the exterior surface of outer housing wall 18, as shown. On its outer surface stiffener 22 carries fixed, fore and aft aligned eyelets 23 and 24 which serve as guides for a fuse arming lanyard 25.

Forward end plate 15 centrally carries a rigidly fixed, internally threaded fitting 26, which receives and supports the inner end of a tubular fuse support 27. Support 27 extends centrally through and well beyond the forward end of nose cone 11 and a suitable proximity fuse 28 is fixed on the forward outer end of the support.

The fuse illustrated is a standard stab detonator type, identified by the Department of Defense (Army) as an M158 fuse. Its operation will be subsequently described. The fuse illustrated can be classed as a proximity fuse because it is positioned ahead of the nose of the bomb, and it is detonated by impact before the bomb housing actually contacts the target. By varying the length of fuse support 27, the fuse detonation time prior to fuel cloud detonation can be varied.

Furthermore, that portion of fuse support 27 which extends beyond the forward end of nose cone 11 may be eliminated and an entirely different type of proximity fuse secured to the nose cone. Other suitable fuzes are the Radar Proximity Fuse Mark 43 TDD, the Infra-Red Air Proximity Fuse, or the omni-directional, stab pin-percussion cap, explosive train fuse FMU 68, all of which are in common use by the Department of Defense, and are of well known construction.

Regardless of the type of fuse used, the explosive element of the fuse is connected to a length of prima cord 29, which extends through fuse support 27, through fitting 26, and well into a body of low brisance dynamite gel, with which chamber 19 is packed. The inner end of the prima cord fuze train is designated by numeral 30.

Referring now to the aft end of the bomb, rear end plate 14 centrally carries a fixed internally threaded tubular fitting 31, which receives and supports a cloud detonator assembly in a position immediately adjacent the rear end plate 14, the cloud detonator assembly being designated as a whole by the numeral 32.

Aft end plate 14 is provided with a filler hole for chamber 20, which is sealed by a plug 33 after chamber 20 has been filled, preferably with a mono propellant, flammable rocket fuel such as normal-propyl nitrate, which is non-gaseous at standard temperature and pressure, and is non-explosive in its normal liquid condition. However, this fuel is highly explosive when dispersed into the air in minute particles to form an aerosol cloud of substantially uniform fuel-air density.

Chamber 20 is also provided with a short vent tube 34, which extends through end plate 14, and the outer end of which is crimped and sealed after the chamber has been filled.

A short filler tube 35, for chamber 21, also passes through end plate 14, and the outer end of tube 35 is also crimped and sealed after chamber 21 has been filled with Freon.

CLOUD DETONATOR ASSEMBLY

Figure 3:
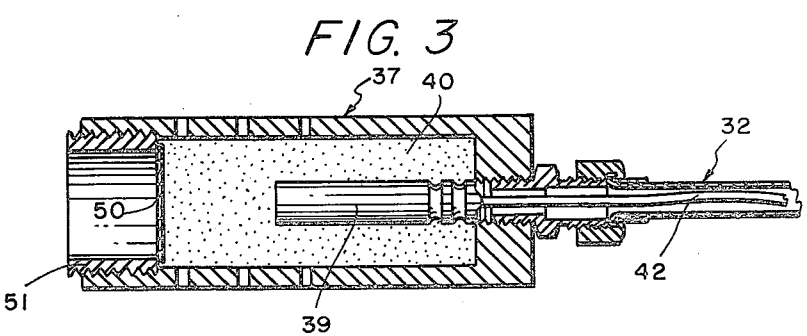
FIG. 3 is an enlarged longitudinal sectional view through one explosive output tube of the cloud detonator assembly.
Figure 2:
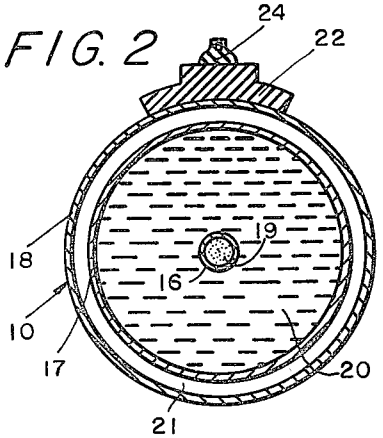
FIG. 2 is a transverse sectional view of the same, taken along the plane indicated by the line 2—2 in FIG. 1.

This assembly 32 consists of two perforated high explosive output tubes 36 and 37, the outer ends of which are closed by a thin membrane 50 fixed to the inner end of a threaded plug 51, FIG. 3. The two output tubes 36 and 37 are mounted in aligned, opposed relationship, for redundancy. They are respectively supported on the opposite outer ends of a dense metal "T" fitting 38, which in turn is threaded into and supported by the fitting 31 in aft end plate 14.

As shown in FIG. 3, the inner end of each output tube internally supports a standard pyrotechnic time delay detonator 39 having a predetermined time delay of around 100 milliseconds. Each detonator 39 is embedded in a body 40 of high explosive, such as TNT, RDX, or PETN, carried by each output tube.

The time delay detonator 39 in each output tube is connected to a length of prima cord, and each cord extends through "T" fitting 38 well into the low brisance explosive in chamber 19. The inner ends of the two cords are designated by the numerals 41 and 42.

When the described cloud detonator assembly 32 and the tail assembly 12 are in assembled relationship, as shown in FIG. 1, the respective outer ends of the detonator output tubes 36 and 37 are positioned adjacent and in alignment with respective apertures 43 and 44 in the cylindrical wall of the tail assembly. As a safety measure these apertures remain plugged by suitable plugs (not shown) until the bomb is readied for drop. The aft end of the cylindrical wall of assembly 12 is preferably closed by a flat plate 45 so that assembly 12 provides a protective housing for cloud detonator assembly 32.

OPERATION

When the described bomb is mounted in a bomb rack, eyelet 46, through which arming lanyard 25 is threaded, is connected to the rack.

When the bomb rack is actuated to jettison the bomb, secured eyelet 46 pulls aft on lanyard 25, which is connected to slide pin 47 of fuse 28, and pulls pin 47, out of its propeller blocking position. Free fall of the bomb causes air driven propeller 48 of fuse 28 to spin. A predetermined number of propeller revolutions retracts a detonator holding screw within the fuse 28 and retraction of the screw permits a stab pin detonator to be spring rotated into alignment with an impact firing pin in the fuse. This completes safe arming of the fuse firing circuit after the bomb has left the carrier. Details in the construction of fuse 28 are not shown and are not considered necessary because they are well known to those familiar with this art, and the specifications for the M158 fuse are fully disclosed in Army Manual TO 11A-1-31 OP1664 (Vol.2) -PP471-473. Furthermore, almost any type of military qualified proximity fuse can be used with this bomb, as previously explained.

As the bomb during its free fall approaches the target, fuse 28 makes target impact before housing 10 reaches the target proper. Impact of the fuse 28 forces the fuse firing pin into the stab detonator within the fuse. The detonator fires and sends an explosive shock wave along the prima cord 29 into the low brisance gelatin dynamite in chamber 19 and detonates that explosive.

The heaving explosion energy is transmitted to the liquid normal-propyl nitrate in chamber 20. The hydrostatic pressure generated by the central burster explosion ruptures and shatters the walls of all three chambers 19, 20 and 21, and ejects and disperses liquid fuel particles into the surrounding air, forming a rapidly expanding, free standing aerosol cloud surrounded by Freon gas. The fuel-air mixture of the cloud formed is of substantially uniform density and the fuel-oxygen mixture in the cloud is highly explosive. Autoignition of the cloud formed is prevented by the cooling effect of the surrounding blanket of Freon gas.

Detonation of the gelatin dynamite central burster charge 19 propagates shock waves which are transmitted by prima cords 41 and 42 to the detonators 39 in the respective high explosive output tubes 36 and 37. After the pre-determined time delay, as for instance 100 milliseconds, detonators 39 detonate the high explosive charges 40 in tubes 36 and 37, before the aft end plate 14 and its connected cloud detonator assembly 32 have had time to travel through and outside the aerosol cloud. Explosion of the TNT or other high explosive charges 40 detonates the entire previously formed aerosol cloud.

Tests show that detonation of the aerosol cloud generates a shock wave which produces an overpressure of 300 psi radially outward 10 feet from hardware impact point, 200 psi radially outward 20 feet, and 100 psi radially outward 30 feet.

Tests show that aerosol cloud detonation also generates an extremely high overpressure in a downward direction. Calibrated crush indicators, rupture discs, guages, piezo-electric shock transducers, and other diagnostic equipment set in deep fox holes, covered bunker arrays, etc., have shown terminal effects equal to or greater than target damage at ground level and above. This extreme downwardly directed over pressure can only be explained by theory.

In summary the above described invention provides a bomb which is so constructed that it utilizes a relatively safe, normally non-explosive, normally liquid, unpressurized rocket fuel to produce a highly destructive terminal effect on targets; a bomb which forms a highly explosive aerosol type fuel-air cloud of substantially uniform fuel-air density which can be detonated at any location within its boundary; and which, because of the last above specified feature, can be effectively used without any slowing of the terminal velocity of the bomb.

Having described the invention with sufficient clarity to enable those familiar with this art to construct and use it, I claim:

1. A non-incendiary fuel-air cloud forming explosive bomb comprising:

a housing having a plurality of interior chambers;

a confined body of low brisance heaving type, fuel dispersing explosive located centrally in a first chamber within the housing;

a separately confined body of normally non-explosive, flammable liquid fuel surrounding the body of low brisance explosive in a second chamber within the housing;

a separately confined body of high vapor pressure, high heat absorbing capacity fluid surrounding the body of fuel in a third chamber within the housing;

a proximity fuse supported by the housing near its foreward end;

shock wave transmitting means connecting the fuse detonator with the interior of said body of low brisance explosive;

a fuel-air cloud detonating assembly carried by the aft end of the housing, including (a) a confined small quantity of high explosive, and (b) a milliseconds time delay detonator associated with said high explosive for detonating the high explosive a predetermined number of milliseconds after the low brisance explosive in the central housing chamber has exploded; and shock wave transmitting means connecting the interior of the body of low brisance explosive with said time delay detonator, whereby the time measuring component of the time delay detonator is actuated when the low brisance explosive explodes, the time delay affords time for the heaving explosion of the low brisance explosive to rupture the housing chambers, disperse the fuel in minute particles into the air to form a fuel-air mixture, aerosol type, highly explosive free standing cloud adjacent the target, and the small high explosive charge of the cloud detonating assembly is exploded to detonate the entire cloud after it has formed during the milliseconds time delay.

2. The bomb described in claim 1, and:

a tail assembly supported by the aft end of the housing and including;

(a) a protective enclosure for the cloud detonating assembly, and (b) aerodynamic fins supported by the enclosure for stabilizing the free fall of the bomb through the air.

3. The bomb described in claim 1 in which:

the low brisance explosive in the central first chamber of the housing is gelatin dynamite;

the normally non-explosive flammable fuel in said second chamber is normal-propyl nitrate; and the body of high vapor pressure, high heat absorbing capacity fluid in said third chamber is Freon gas which forms a cooling blanket surrounding the fuel air mixture aerosol cloud as it is formed, and prevents autoignition of the cloud.

4. The bomb described in claim 1 in which the proximity fuse includes a time delay fuse arming mechanism and;

a lanyard connected to said fuse arming mechanism and to the exterior of said housing; and means for connecting an intermediate portion of the lanyard to a fixed portion of an airplane or other bomb carrier, so that when the bomb is released from the carrier the lanyard initiates action of the time delay fuse arming mechanism of the fuse.

5. The bomb described in claim 1 in which:

the housing is elongated and cylindrical in shape;

the first, second and third chambers in the housing are annular in cross-section and are arranged concentrically within the housing, with the second chamber surrounding the first chamber, and the third chamber surrounding the second chamber and the first chamber;

the end walls of the housing are in the form of thick, rigid, heavy metal plates sealing the opposite ends of all three chambers; and one housing end plate is provided with sealable filler openings, one for each of the three chambers in the housing.

* * * * *